US010184302B2

(12) United States Patent
Thomson et al.

(10) Patent No.: US 10,184,302 B2
(45) Date of Patent: Jan. 22, 2019

(54) MORPHING TUBULARS

(71) Applicant: SCHLUMBERGER TECHNOLOGY CORPORATION, Sugar Land, TX (US)

(72) Inventors: Neil Thomson, Aberdeen (GB); Peter Wood, Aberdeen (GB); Daniel O'Brien, Stonehaven (GB); David Glen Martin, Keith (GB); William Luke McElligott, Exeter (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/821,900

(22) Filed: Aug. 10, 2015

(65) Prior Publication Data

US 2016/0047178 A1 Feb. 18, 2016

(30) Foreign Application Priority Data

Aug. 12, 2014 (GB) ..... 1414308.5
Sep. 12, 2014 (GB) ..... 1416187.1
Oct. 5, 2014 (GB) ..... 1417572.3

(51) Int. Cl.
*E21B 17/04* (2006.01)
*E21B 19/16* (2006.01)
*E21B 43/10* (2006.01)

(52) U.S. Cl.
CPC ..... *E21B 17/04* (2013.01); *E21B 19/16* (2013.01); *E21B 43/106* (2013.01); *E21B 43/108* (2013.01)

(58) Field of Classification Search
CPC ..... E21B 17/04; E21B 19/16; E21B 43/106; E21B 43/108
See application file for complete search history.

(56) References Cited

U.S. PATENT DOCUMENTS 3,710,864 A * 1/1973 Mitchell ..... E21B 29/10 166/242.6
4,576,386 A * 3/1986 Benson ..... F16J 15/166 277/584
4,593,448 A * 6/1986 Ferrari Aggradi ..... B21D 39/04 138/147

(Continued)

FOREIGN PATENT DOCUMENTS

WO WO 00/37772 6/2000
WO 2014/151886 A2 9/2014

OTHER PUBLICATIONS

EPO as International Search Authority, International Search Report and Written Opinion for PCT/GB2015/052246, dated Nov. 4, 2015.

(Continued)

*Primary Examiner* — Matthew R Buck

(57) ABSTRACT

Apparatus and method for sealingly connecting tubular members in a wellbore. In a connector apparatus where a portion of a tubular member is radially expanded into sealing contact within a second tubular member, and the second tubular member has circumferential recesses on an inner surface, an annular resilient band member is arranged in the recesses. The annular resilient band member is acted on by the portion of the tubular member during expansion and maintains sealing contact to the portion after expansion.

18 Claims, 3 Drawing Sheets

(56) References Cited

U.S. PATENT DOCUMENTS

| | | | | | |
|---|---|---|---|---|---|
| 4,662,663 | A * | 5/1987 | Schmitz | B21D 39/04 | 285/382.5 |
| 4,925,220 | A * | 5/1990 | Szymczak | B21D 39/04 | 285/331 |
| 5,010,952 | A * | 4/1991 | Chin | E21B 33/04 | 166/206 |
| 5,348,092 | A * | 9/1994 | Cornette | E21B 17/22 | 166/114 |
| 5,829,524 | A * | 11/1998 | Flanders | E21B 17/08 | 166/242.7 |
| 6,409,175 | B1 * | 6/2002 | Evans | A63F 3/00157 | 273/269 |
| 7,017,670 | B2 * | 3/2006 | Hazel | E21B 29/10 | 166/147 |
| 2007/0257486 | A1 * | 11/2007 | Filippov | E21B 43/106 | 285/382.2 |
| 2010/0052319 | A1 * | 3/2010 | Benzie | F16L 15/04 | 285/382.2 |
| 2012/0227984 | A1 * | 9/2012 | Thomson | E21B 43/108 | 166/380 |
| 2014/0000911 | A1 * | 1/2014 | Gorrara | E21B 43/106 | 166/380 |
| 2014/0008082 | A1 * | 1/2014 | O'Brien | E21B 19/16 | 166/380 |

OTHER PUBLICATIONS

GB Combined Search and Examination Report for corresponding GB Application Serial No. 1513759.9, dated Feb. 9, 2016, 5 pages.

* cited by examiner

MORPHING TUBULARS

The present invention provides an apparatus and a method for connecting tubular members in a wellbore and in particular provides an apparatus and a method for sealing and/or securing a first (inner) tubular to a second (outer) tubular in a wellbore and thereby providing an annular seal between the first and second tubular members.

In wellbore drilling and completion, various tubular elements (also typically referred to in the industry as "tubulars") need to be connected to each other. For example, in well completions, a number of tubulars may have to be connected end to end in order to form a string of tubulars such as a casing string or liner string to line the wellbore to the required depth. In some cases, one tubular has to be set inside another tubular by increasing the diameter of the inner tubular until it contacts the inner wall of the outer tubular and creates an interference fit therewith. The connection between the tubulars very often must be capable of withstanding axial loads (i.e. secured). The connection should also be fluid tight to provide an annular barrier between the tubulars (i.e. sealed) to prevent fluid passage between the internal bore of the outer tubular and the exterior of the inner tubular.

One prior art arrangement for connecting tubular members in a wellbore is described in WO2011/048426 A2 and includes a metal to metal seal between first and second tubular members A,B in a cased wellbore, as shown in FIGS. 1 and 2 of the present application. The second (lower) tubular member B includes an upper end portion C which has a greater inner diameter than the outer diameter of a lower end portion D of the first (upper) tubular member A. Circumferential recesses or grooves E are formed on the inner surface or bore of the upper end portion C of the second (lower) tubular member B. In order to form the seal, firstly, the lower end portion D of the first tubular member A is located within the upper end portion C of the second tubular member B. Next, a hydraulic expansion tool F is lowered from surface inside the first tubular member A to the intended location of the seal (see FIG. 2 of the present application). The tool F seals off a chamber G between a pair of axially spaced apart seals H. Actuation of the hydraulic expansion tool F causes chamber G to be filled with fluid under high pressure, and this high pressure fluid acts on the inner surface or bore of the lower end portion D of the first tubular member A to first elastically and then plastically expand so that the lower end portion D expands radially outwardly along a length bounded by the seals H into the recesses E on the inner bore of the second tubular member B such that circumferential protrusions I or ridges are formed on the outside of the lower end portion D of the first tubular portion A. These protrusions I are received in the recesses E until a seal is formed between the first and second tubular members A, B.

In this way, a liner tieback is formed. A similar technique is used to connect an overshot device with a tubular downhole, e.g. casing or liner, in fishing operations, to engage an inner bore surface of the overshot device with the outer surface of the tubular, to allow jarring and retrieval of the tubular. This technique also provides a casing reconnect.

A known problem associated with the above described arrangement is that well fluid present at the interface between the tubular members A, B may become trapped in the recesses E which can lead to the formation of hydraulic lock which is potentially damaging to the tubular members. Additionally, when the pressure used to morph the first tubular member A to the second tubular member B is released, the trapped fluid pressure within the recesses E may cause separation of the members A, B causing the metal to metal seal created at the contact point 3 (see FIG. 3) to be lost as the first member A is forced away from the second member B.

It is an object of the present invention to provide a connector apparatus for sealingly connecting to a tubular member in a wellbore which obviates or mitigates at least some of the disadvantages of the prior art.

According to a first aspect of the invention there is provided a connector apparatus for sealingly connecting to a tubular member in a wellbore, the connector apparatus comprising:

- a substantially cylindrical body having a receiving section adapted to receive therein at least one portion of the tubular member for permitting expansion of the said at least one portion radially outwardly against one or more circumferential recesses on an inner surface of the receiving section until one or more joints are formed between the said at least one portion and the receiving section;
- wherein, at least one annular resilient band member is arranged in at least one of said recesses, the at least one annular resilient band member being acted on by the at least one portion during expansion and maintaining sealing contact to the at least one portion after expansion.

In this way, when the pressure is released after expansion of the tubular member, the annular resilient band member will move with the tubular member to ensure a seal is maintained between the connector apparatus and the tubular member around the entire circumference of the connector apparatus.

Preferably, the annular resilient band member is entirely contained within the recess. In this way, the annular resilient band member does not interfere with the tubular member being located in the receiving section.

Preferably, there are two annular resilient band members, oppositely arranged at either end of the recess. In this way, an annular resilient band member is arranged adjacent a side wall of the recess and a seal is maintained at either side of the recess.

Preferably, the annular resilient band member has an upper surface and a lower surface, the surfaces being separated by a depth of the recess. In this way, the annular resilient band member bridges the recess a the tubular member will make contact therewith.

Preferably, a back-up ring is located between the annular resilient band member and a side wall of the recess. This can assist in preventing extrusion of the annular resilient band member. More preferably the back-up ring extends circumferentially around the side of the annular resilient band member. In this way, extrusion is prevented around the recess.

Preferably the back-up ring is metal. In this way, the back-up ring does not deform. Alternatively, the back-up ring is formed from PEEK. In this way, the back-up ring is easier to insert in the recess.

Preferably, the annular resilient band member has a profile on a first side wall and the back-up ring has a matching profile on a first side wall so that the annular resilient band member is received in the back-up ring. In this way, the annular resilient band member is held within the recess during deployment.

Preferably, there are two annular resilient band members at each side of a recess. In this way, a seal is maintained at each side of the recess.

Preferably, the annular resilient band member is an elastomer. In this way, the elastomer can be compressed during the morph but will spring back to maintain a seal when the tubular member relaxes.

Preferably, the annular resilient band member is an activated memory metal. In this way, it can become resilient at the temperature and pressure used for morphing.

Preferably, the annular resilient band member is metal coated. In this way, the annular resilient band member can be an elastomer to give resilience but also provide a metal to metal seal with the tubular member.

Preferably, a plurality of recesses is linearly arranged along the inner surface of the receiving section and at least one recess includes at least one annular resilient band member. More preferably, a recess includes two opposing annular resilient band members. Alternatively, there is a pair of neighbouring recesses with an annular resilient band member adjacent each side wall of the adjoining rim between the recesses.

Preferably, the one or more created joints are either sealed or secured connections or, more preferably, are both sealed and secured joints. The so formed joint created between the connector apparatus and the tubular member has the ability to withstand axial loads and fluid pressures acting between the connector apparatus and the tubular member. The joint preferably creates both a mechanical fixing between the two tubular members and also a hermetic seal between the connector apparatus and the tubular member. Preferably, the joint is formed as a result of initially elastic and then plastic deformation of the material of at least the said at least one portion and, preferably also the receiving section of the connector apparatus.

The outward expansion may be achieved, for example, by application of radial outward pressure or force to side walls of the said at least one portion of the tubular member within an inner bore of the said at least one portion.

In an embodiment, a fluid exclusion device is located in one or more recesses. The fluid exclusion device may be provided having an annular configuration, e.g. in the form of a ring. The fluid exclusion device may comprise a fluid exclusion material, which may comprise a crushable medium, such as, for example closed cell foam, such as, for example, metal foam or syntactic foam, placed in the recess in order to prevent fluid from filling the recess but being collapsible under the pressure of the at least one portion so as to allow a protrusion of the at least one portion to enter the recess. The fluid exclusion device is also preferably capable of taking in some fluid whilst being collapsed thereby further minimising the risk of occurrence of a hydraulic lock. Such fluid may be present about the fluid exclusion device prior to the fluid exclusion device being collapsed or may be displaced towards the fluid exclusion device during expansion of the said at least one portion of the tubular member. Alternatively or additionally, the fluid exclusion device comprises a collapsible ring, such as, for example, a hollow ring, in the or each recess, the ring being configured to collapse when the ring experiences certain pressure. The collapsible ring works in a manner similar to the fluid exclusion foam, i.e. by preventing fluid from entering the recess when the ring is intact whilst collapsing under the force of the circumferential protrusion of the said at least one portion of the second tubular member. A collapsible ring can function at higher temperatures and pressures than those withstandable by foam. Also, an appropriately selected collapsible ring may be capable of accommodating greater fluid volume than foam.

In a further embodiment, a port may be located through the base of one or more recesses. The port provides a fluid exit path to relieve pressure from within the recess during morphing by evacuating it to the outside of the connector apparatus.

The said at least one portion of the tubular member can be expanded by an appropriate tool, such as for example a conventional prior art hydraulic expansion tool, a cone displacement tool, rollers, or any other tool capable of increasing the inner diameter of the said at least one portion.

The connector apparatus could be any sort of tubing used downhole, for example, an overshot device for fishing operations, or indeed casing, liner, tieback liner or production tubing, etc. which needs to be fitted over an outer surface of another smaller diameter tubing for example, as a liner tieback or casing reconnect. Similarly, the tubular member can comprise any sort of tubing, tubular, conduit or pipe used downhole e.g. liner for a liner tieback and casing for a casing reconnect.

According to a second aspect of the invention there is provided a method of connecting tubular members in a wellbore, the method comprising the steps of:— a) providing a connector apparatus according to the first aspect;
b) placing the said at least one portion within the receiving section of the connector apparatus;
c) expanding the said at least one portion radially outwardly against the receiving section until one or more joints are formed between the said at least one portion and the receiving section;
d) acting on the annular resilient band member by the at least one portion during expansion; and
e) acting on the at least one portion by the annular resilient band member following expansion to maintain sealing contact between the annular resilient band member and the at least one portion after expansion.

In this way, when the pressure is released after expansion of the tubular member, the annular resilient band member will move with the tubular member to ensure a seal is maintained between the connector apparatus and the tubular member.

Preferably, the method includes the step of directing pressurised fluid out the at least one recess. This step may be by directing fluid through a port in the recess to the outside of the connector apparatus.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. All positional terms such as 'up' and 'down', 'left' and 'right' are relative and apply equally in opposite and in any direction.

Embodiments of the present invention will now be described, by way of example only, with reference to the accompanying drawings in which.

Figure 4:
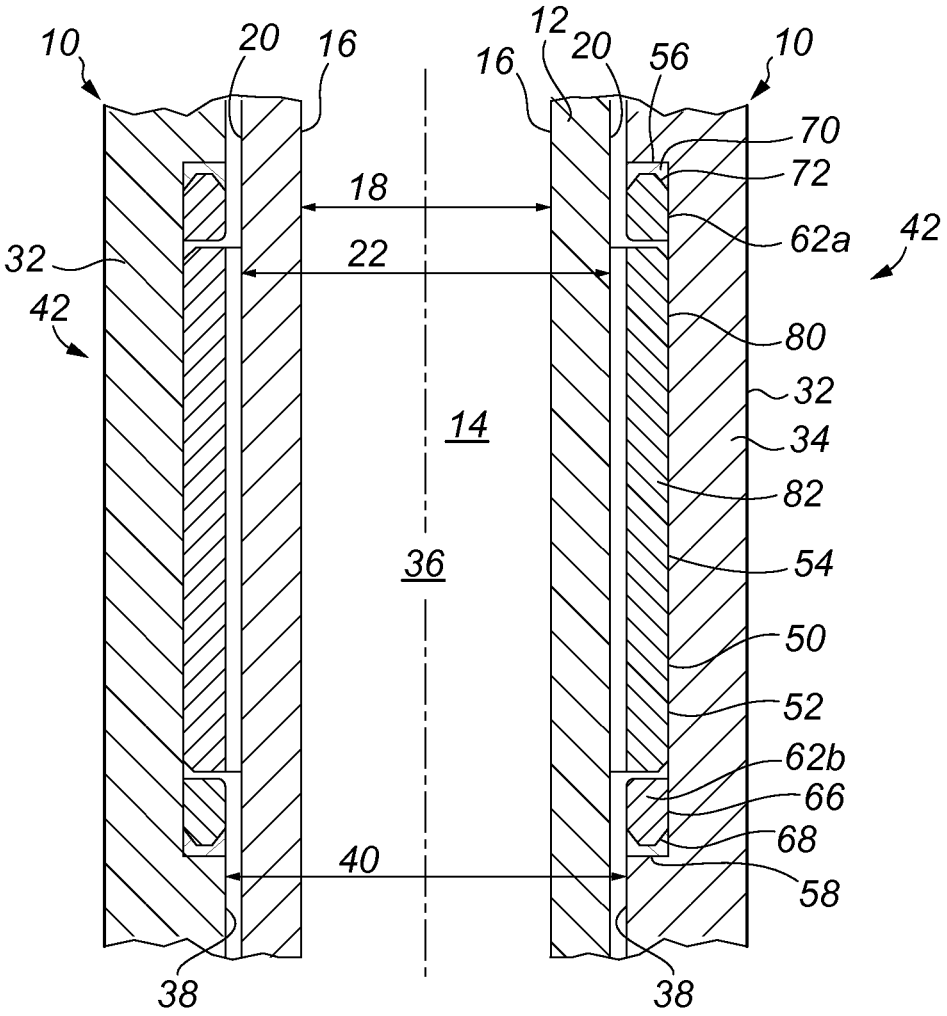
FIG. 4 is a schematic illustration of a sectional side view of an arrangement for connecting tubular members according to an embodiment of the present invention.

Referring initially to FIG. 4 there is provided a connector apparatus generally indicated by reference numeral 10 for providing a sealed connection to a first tubular member 12 according to an embodiment of the present invention.

The first tubular member 12 has a substantially cylindrical body having a bore 14 therethrough providing an inner surface 16 with a first diameter 18 and an outer surface 20 with a second diameter 22 along the majority of its length (not shown). The first tubular member 12 is of metal construction and has dimensions typical of tubulars round in the oil and gas industry as used in tubing strings, casings and liners. The first tubular member 12 has a first end 24 with an annular end face 26 which is substantially perpendicular to the longitudinal axis of the bore 14.

In this embodiment, a second tubular member 32 has a substantially cylindrical body 34 having a bore 36 therethrough providing an inner surface 38 with an inner diameter 40 along the majority of its length (not shown). The inner diameter 40 is the narrowest section of the tubular member 32. The second tubular member body 34 is of metal construction and has dimensions typical of tubulars round in the oil and gas industry as used in tubing strings, casings and liners. The second tubular member 32 has a first end 42 with an annular face 44 which is substantially perpendicular to the longitudinal axis of the bore 36.

Figure 5:
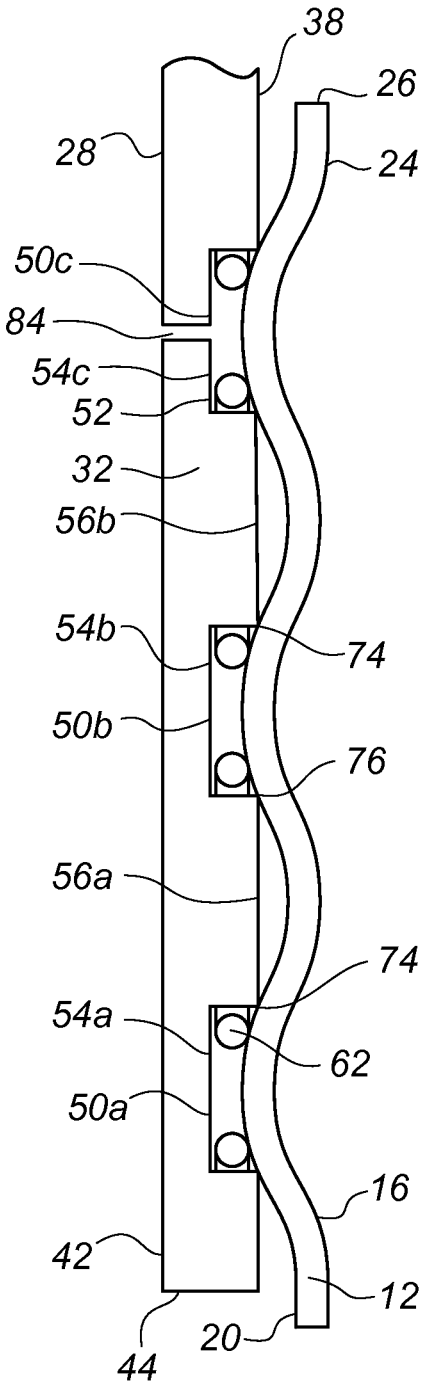
FIG. 5 is a schematic illustration of a sectional side view of a detail of an arrangement for connecting tubular members according to an embodiment of the present invention.

The connector apparatus 10 is integrally formed with, and will be described with reference to, a first end 42 of the second tubular member 32. On the inner surface 38 of the length of connector apparatus arranged at the first end 42 of the second tubular member 32 there is provided a series of profiled sections 50*a-c*. This is best seen in FIG. 5. Each profiled section 50 is a shape machined into the inner surface 38. The shape of each section 50 is entirely circumferential in that, a cross sectional view, as shown in FIGS. 4 and 5, is the same for every cross-section around the tubular 32.

Each profile section provides circumferential groove 54*a-c*. The grooves 54 are rectangular cut outs forming a complete annular ring. The grooves 54, when formed adjacent one another, are equidistantly spaced with a rim 56*a, b*, which has a rectangular profiled, is located between the grooves 54*a-c*. The rim 56 may be considered as a circumferential band, bead or protrusion facing the bore 34. While three adjacent grooves 54*a-c* are arranged adjacent one another in the present embodiment, it will be understood that any number of grooves may be arranged adjacent one another in this arrangement. In this embodiment, a width of each groove 54 is equal to a corresponding width of each rim 56 although any relationship can be used.

In FIG. 4, a single groove 54 is illustrated in greater detail. Groove 54 has an upper side wall 56, an opposing lower side wall 58 and a base 52. Adjacent the side walls 56, 58 are annular resilient band members 62*a, b*. Each member 62 is identical but oppositely arranged within the groove 54. Each member 62 is a continuous ring of elastomer, sized to sit entirely within the groove 54, such that its inner diameter is greater than the inner diameter 40 of the tubular member 32. This prevents the elastomer being damaged on run-in.

While an elastomer is preferred for the member, other embodiments such as a metal coated elastomer or a heat/pressure activated memory metal may also be used.

The member 62 has base 66 which rests upon the base 52 of the groove 54. The base 52 provides a static surface so that the member 62 can be compressed against the base 52. The member 62 is substantially rectangular in cross section with side wall 68 which is curved outwards to provide a profiled edge. This profiled edge is arranged to fit within a matching profile on a side wall 72 of a back-up ring 70. The profile on side wall 72 is curved inwards providing a lip at the edge of the groove 54 and at the base 52. This arrangement provides a shaped elastomer and allows the member 62 to sit within the ring 70 and thereby prevent its extrusion from the groove 54. The back-up ring 70 sits between the member 62 and the side wall 56, 58 respectively. The back-up ring is preferably made of PEEK but any mechanical ring would suffice. Such back-up rings are known in the art.

The groove 54 is further provided with fluid exclusion means 80. Fluid exclusion means are operable to exclude fluid from the interface between groove 54 and the outer surface 20 of first tubular 12 to minimize the occurrence of a hydraulic lock during the morphing process. In the presently described embodiment at FIG. 4, the fluid exclusion means 80 comprises a fluid exclusion ring 82 made of a fluid exclusion material, for example closed cell foam such as metal foam or syntactic foam although it will be appreciated that other suitable material may be used.

Fluid exclusion ring 82 is an annular ring with a substantially rectangular or square profile. The fluid exclusion ring 82 is placed in the recess 54 with ring 82 placed centrally and resilient members 62*a, b* placed on either side of the ring 82. The ring fills the remaining space within the groove 54 and thus prevents a pocket of fluid from sitting in the groove 54. The fluid exclusion ring 82 is crushable or collapsible under external pressure. The fluid exclusion ring is preferably capable of taking in some fluid whilst being collapsed thereby further minimising the risk of occurrence of a hydraulic lock. Such fluid may be present around the fluid exclusion ring 82 prior to being collapsed or may be displaced towards the fluid exclusion ring 82 during expansion of the first tubular member 12.

An alternative fluid exclusion means 80 is shown in groove 54*c* in FIG. 5. Groove 54*c* still contains the members 62 and the back-up rings 70, but there is nothing lated between the opposing members 62*a, b*. Instead, a port 84 is formed from the base 52 to the outer surface 28 of the tubular member 32. This provides an aperture of conduit for fluid to flow from the groove 54 to outside the connector apparatus 10. By providing a fluid pathway out of the groove 54*c*, hydraulic lock is prevented.

With reference to FIG. 5, in use, the first end 24 of the first tubular member 12 is inserted into the first end 42 of the second tubular member 32 until the annular end face 26 of the first end 24 extends beyond the groove 54*c* of connector apparatus 10 such that the grooves 54 are co-axially arranged around the outer surface 20 of the first tubular member 12. A metal to metal seal is created between the outer surface 20 of the first end 24 of the first tubular member 12 and the grooves 54 of the connector apparatus 10 arranged at the first end 42 of the second tubular member 32. This is achieved by applying force to the inner surface 16 at the first end 24 of the tubular member 12.

The seal may be created by use of a hydraulic tool (not shown). A detailed description of the operation of such a hydraulic tool is described in GB2398312 in relation to the packer tool 112 shown in FIG. 27 of GB2398312 with suitable modifications thereto, where the seal means 92 could be provided by suitably modified seal assemblies 214, 215 of GB2398312, the disclosure of which is incorporated herein by reference. The entire disclosure of GB 2398312 is incorporated herein by reference.

Figure 1:
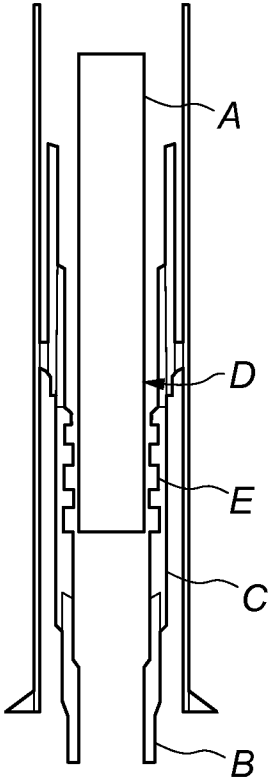
Fig. 1 (PRIOR ART)
FIGS. 1 and 2 are sectional side views of stages of a prior art method of connecting tubular members and therefore do not form part of the present invention.
Figure 2:
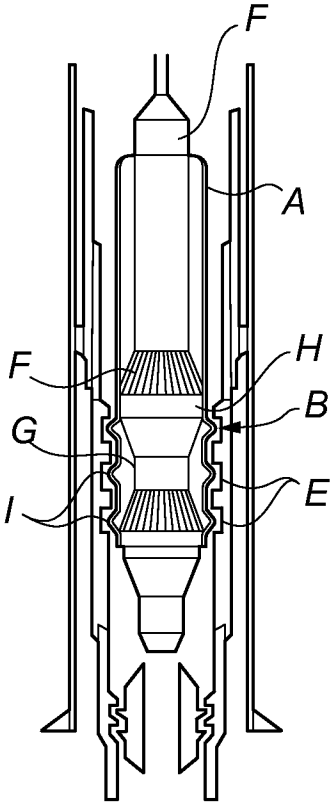
Fig. 2 (PRIOR ART)
Figure 3:
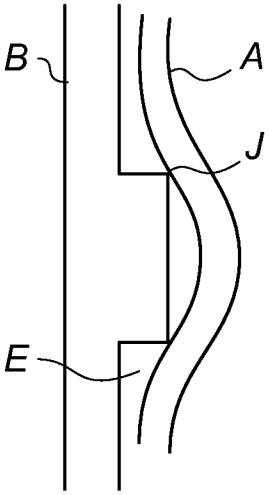
Fig. 3 (PRIOR ART)
FIG. 3 is an exploded view of part of the sectional side view of the connection in FIG. 2 and therefore does not form part of the present invention.

The tool is inserted into the tubulars 12, 32 and located within the bore 14 of the first tubular member 12. Elastomeric seals are arranged on the tool to straddle the grooves 54*a-c* and lie over the inner surface 16 of the tubular member 12. When in position, the elastomeric seals are energised so that they expand radially outwardly and create a seal between the outer surface of the tool body and the inner surface 16 of the first tubular member 12. With the seals energised, a chamber is created which is bounded by the outer surface of the tool, the inner surface 16 and the elastomeric seals. Hydraulic fluid is then pumped through the tool body so that it exits a port and enters the chamber. Once the chamber is filled, continued pumping forces the outer surface 20 of the first end 24 of the tubular member 12 to move radially outwardly by the use of fluid pressure acting directly on the inner surface 16 between the elastomeric seals. Sufficient hydraulic fluid pressure is applied to move the outer surface 20 of the first end 24 of the tubular member 12 radially outwards and cause the tubular member 12 to morph itself onto the inner surface 38 of the first end 42 of the second tubular member 32. This is as per the prior art described with reference to FIGS. 1 and 2.

During the morphing process, the first tubular member 12 will undergo elastic expansion filling, or at least partially filing the grooves 54*a-c*. The resilient members 62 will be acted upon by the outer surface 20 of the morphing first tubular 12 and will be compressed inwards towards the base 52 of each groove 54. The resilient member 62 will seal against the outer surface 20 of the first tubular 12. Continued expansion will cause the tubular member 12 to undergo plastic deformation. Sufficient pressure may be applied to also cause the first end 42 of the second tubular member 32 to elastically deform. When the pressure is released the first end 42 will return to its original dimensions and create a seal against the deformed end 24 of the tubular member 12. Similarly, upon release of the hydraulic fluid pressure if any reduction in expanded dimensions of inner tubular 12 occurs, the resilient members 62 will expand to maintain sealing contact with the inner tubular 12.

During the morphing process, the outer surface 20 of the end 24 of the first tubular member 12 will take up the shape of the inner surface 38 of the first end 40 of the second tubular member 32. A metal to metal seal is preferentially achieved between the first tubular member 12 and the second tubular member 32 at the corner edges 74, 76 of the grooves 54. At each groove 54, there are two points 74, 76 for a seal, so for several grooves there are multiple sealing points. At each groove 54, the members 62 also provide an extended surface area over which a resilient seal occurs as well as the points 74, 76 around which the tubular member 12 bends when it is morphed into groove 54. The grooves 54 provide for vertical loading when the tubular members 12, 32 are arranged for insertion into the well bore (not shown) should assembly of the tubulars 12, 32 occur prior to insertion into a well bore. The resilient members 62 at grooves 54 also provide for improved continued sealing being achieved should axial loading occur at the joint. Once the connector apparatus 10 has been activated, the resilient seal provided by the members 62 maintains a seal at either side of the recess 54 which is maintained around the entire circumference of the connector apparatus 10. Furthermore, should a metal to metal seal at a point 74, 76 fail to occur, as illustrated in FIG. 5 at groove 54*a*, a seal is still maintained by the resilient member 62. Such failure of the metal to metal seal can occur when the tubular 12 relaxes on release of the morphing pressure.

When the metal to metal seals are made around the circumference of the tubulars 12, 32 at points 74, 76 fluid may be forced towards the grooves 54. Where a syntactic foam is present, the fluid is initially diverted over the rim 56 as there is no space available for fluid to enter the groove 54. However during the morphing process fluid may be trapped at the groove and the foam will crush under the pressure of the fluid to provide a void in which the fluid can enter. In groove 54*c*, the fluid may enter the void in the groove 54*c* during morphing and is free to travel out of the groove through the port 84. Both of these fluid exclusion means 80 prevent hydraulic lock which would inhibit a metal to metal seal being formed.

With the joint between the first tubular member 12 and the second tubular member 32 made, the elastomeric seals on the tool are de-energised so that they come away from the surface 20. The tool can then be removed from the tubular members 12, 32.

The connection joint formed between the first tubular member 12 and second tubular member 32 by connector arrangement 10 has the ability to withstand axial loads and fluid pressures acting between the first tubular member 12 and the second tubular member 32. The joint creates both a mechanical fixing between the two tubular members 12, 32 and a hermetic seal between the tubular members 12, 32.

If a metal to metal seal is also required at the resilient members, then this can be achieved by metal coating the elastomer or using a heat/pressure activated memory metal as the resilient member 62.

The principle advantage of the present invention is that it provides a connection apparatus for joining two tubular members in which following morphing, a seal is maintained even when the tubular members relax or a metal to metal seal fails to be formed.

A further advantage of the present invention is that it provides a connection apparatus for joining two tubular members in which an inexpensive, easy to fit annular resilient band can be used to maintain a seal.

It will be appreciated by those skilled in the art that modifications may be made to the invention herein described without departing from the scope thereof. For example, when the tubular members have been described as metal structures, only the end portions need to have metal to form the seal and thus the tubular members may be of composite form with metal ends. While the grooves are shown in rectangular cross-section they may be of any shape or configuration.

We claim:

1. A connector apparatus for sealingly connecting to a tubular member in a wellbore, the connector apparatus comprising:

a substantially cylindrical body having a receiving section adapted to receive therein at least one portion of the tubular member for permitting expansion of the at least one portion radially outwardly against one or more circumferential recesses undercut into the substantially cylindrical body and disposed beyond an inner surface of the receiving section, the expansion continuing until one or more joints are formed between the at least one portion and the receiving section;

wherein, two annular resilient band members are oppositely arranged at an upper end and a lower end of the one or more recesses, the two annular resilient band members being acted on by the at least one portion during expansion and maintaining sealing contact to the at least one portion after expansion.

2. A connector apparatus according to claim 1 wherein the two annular resilient band members are entirely contained within the one or more recesses.

3. A connector apparatus according to claim 1 wherein each of the two annular resilient band members has an upper surface and a lower surface, the surfaces being separated by a radial depth of the one or more recesses.

4. A connector apparatus according to claim 1 wherein each of two back-up rings is located between a side of each of the two annular resilient band members and a side wall of the one or more recesses.

5. A connector apparatus according to claim 4 wherein each of the two back-up rings extends circumferentially around the side of each of the two annular resilient band members.

6. A connector apparatus according to claim 4 wherein each of the two back-up rings is metal.

7. A connector apparatus according to claim 4 wherein each of the two back-up rings is formed from PEEK (PolyEtherEtherKetone).

8. A connector apparatus according to claim 5 wherein each of the two annular resilient band members has a profile on a first side wall and each of the two back-up rings has a matching profile on a first side wall so that each of the two annular resilient band members is received in each of the two back-up rings.

9. A connector apparatus according to claim 1 wherein each of the two annular resilient band members is an elastomer.

10. A connector apparatus according to claim 1 wherein each of the two annular resilient band members is an activated memory metal.

11. A connector apparatus according to claim 9 wherein each of the two annular resilient band members is metal coated.

12. A connector apparatus according to claim 1 wherein the one or more recesses comprises a pair of neighboring recesses with an annular resilient band member disposed adjacent to each side wall of an adjoining rim extending between the pair of neighboring recesses.

13. A connector apparatus according to claim 1 wherein the one or more formed joints are either sealed or secured connections or are both sealed and secured connections.

14. A connector apparatus according to claim 1 wherein a fluid exclusion device is located in the one or more recesses and the fluid exclusion device is provided having an annular configuration.

15. A connector apparatus according to claim 14 wherein the fluid exclusion device comprises a fluid exclusion material comprising a crushable medium selected from a group comprising: closed cell foam, metal foam or syntactic foam.

16. A connector apparatus according to claim 14 wherein the fluid exclusion device comprises a collapsible ring.

17. A connector apparatus according to claim 1 wherein a port is located through a base of at least one of the one or more recesses.

18. A method of connecting tubular members in a wellbore, the method comprising the steps of:

a) providing a connector apparatus comprising a substantially cylindrical body having a receiving section adapted to receive therein at least one portion of a tubular member and one or more circumferential recesses undercut into the substantially cylindrical body and disposed beyond an inner surface of the receiving section, and two annular resilient band members are oppositely arranged at an upper end and a lower end in each of the one or more recesses;

b) placing the at least one portion within the receiving section of the connector apparatus;

c) expanding the at least one portion radially outwardly against the receiving section until one or more joints are formed between the at least one portion and the receiving section;

d) acting on each of the two annular resilient band members by the at least one portion during expansion; and e) acting on the at least one portion by each of the two annular resilient band members following expansion to maintain sealing contact between each of the two annular resilient band members and the at least one portion after expansion.

* * * * *